US006129774A

United States Patent [19]

Owens

[11] Patent Number: 6,129,774

[45] Date of Patent: Oct. 10, 2000

[54] CLEAN AIR FLOW CATALYST

[75] Inventor: Jerry B. Owens, Fort Worth, Tex.

[73] Assignee: Clean Air Flow, Inc., Arlington, Tex.

[21] Appl. No.: 09/224,362

[22] Filed: Dec. 31, 1998

Related U.S. Application Data

[63] Continuation-in-part of application No. 09/160,269, Sep. 24, 1998.

[51] Int. Cl.[7] ..... C10L 1/12; F02M 33/00

[52] U.S. Cl. ..... 44/629; 44/639; 123/358

[58] Field of Search ..... 44/321, 629, 639, 44/354, 536; 123/1 A, 1 R, 3, 537, 538; 431/4

[56] References Cited

U.S. PATENT DOCUMENTS

| | | | |
|---|---|---|---|
| 4,050,426 | 9/1977 | Sanderson | 123/119 E |
| 4,429,665 | 2/1984 | Brown | 123/1 A |
| 4,611,615 | 9/1986 | Petrovic | 123/358 |
| 4,715,325 | 12/1987 | Walker | 123/1 A |
| 4,930,483 | 6/1990 | Jones | 123/358 |
| 5,048,499 | 9/1991 | Clark . | |
| 5,249,552 | 10/1993 | Brooks . | |
| 5,449,821 | 9/1995 | Neumann et al. . | |
| 5,470,815 | 11/1995 | Kim et al. . | |
| 5,527,946 | 6/1996 | Flick et al. . | |
| 5,580,359 | 12/1996 | Wright . | |

*Primary Examiner*—Margaret Medley
*Attorney, Agent, or Firm*—Arthur F Zobal

[57] ABSTRACT

The catalyst of the invention includes Aluminium, Lead, Copper, Tin, Antimony, Zinc and Nickel located to be in contact with the fuel to be burned. Each of the elements is present in a preferred concentration range by weight which varies depending on the type of fuel. In a preferred embodiment, the Aluminium forms a container having an inlet and an outlet which defines a flow path through which the fuel flows. The other elements are located in the flow path such that all of the elements are in contact with the fuel as it flows through the container.

23 Claims, 2 Drawing Sheets

CLEAN AIR FLOW CATALYST

SPECIFICATION

This application is a continuation-in-part of application Ser. No. 09/160,269, filed Sep. 24, 1998.

BACKGROUND OF THE INVENTION

1. Field of the Invention

The invention relates to a catalyst for use for reducing fossil fuel emissions and for improving the efficiency of the fuel.

2. Description of the Prior Art

Beginning in December 1941, in Great Britain, Henry Brouquet started placing tin ignots in the fuel tanks of British aircraft. The tin ignots were placed in the aircraft fuel tanks to raise the quality of the inferior Russian aircraft fuel being used by the British war planes. That a catalyst of Tin is still in limited use today with a small degree of success in England.

U.S. Pat. Nos. 5,249,552 and 5,580,359 disclose other types of fuel catalyst or additives.

SUMMARY OF THE INVENTION

It is an object of the invention to provide a catalyst for reducing harmful fuel emissions and for increasing the fuel efficiency of internal combustion engines or the other types of combustion devices.

The invention is a non-sacrificial product, it needs little or no maintenance or disposal instructions and will last for a long period of time.

This invention is packaged in many ways depending on the intended application the catalyst is to be used. The invention needs only to come in contact with the fossil fuel for a short time, the fuel may be directed to flow through a metal fuel line, a canister, a plastic or rubber hose or other flow paths through other types of materials that will deliver the fuel to the combustion chamber or the catalyst invention may simply be immersed into a fuel tank to treat the fuel.

The catalyst of the invention comprises Aluminum, Lead, Copper, Tin, Antimony, Zinc and Nickel located to be in contact with the fuel to be burned.

Each of the element is present in a preferred concentration range by weight which varies depending on the type of fuel.

In a preferred embodiment, the Aluminium forms a container having an inlet and an outlet which defines a flow path through which the fuel flows. The other elements are located in the flow path such that all of the elements are in contact with the fuel as it flows through the container.

DESCRIPTION OF THE PREFERRED EMBODIMENTS

Figure 1:
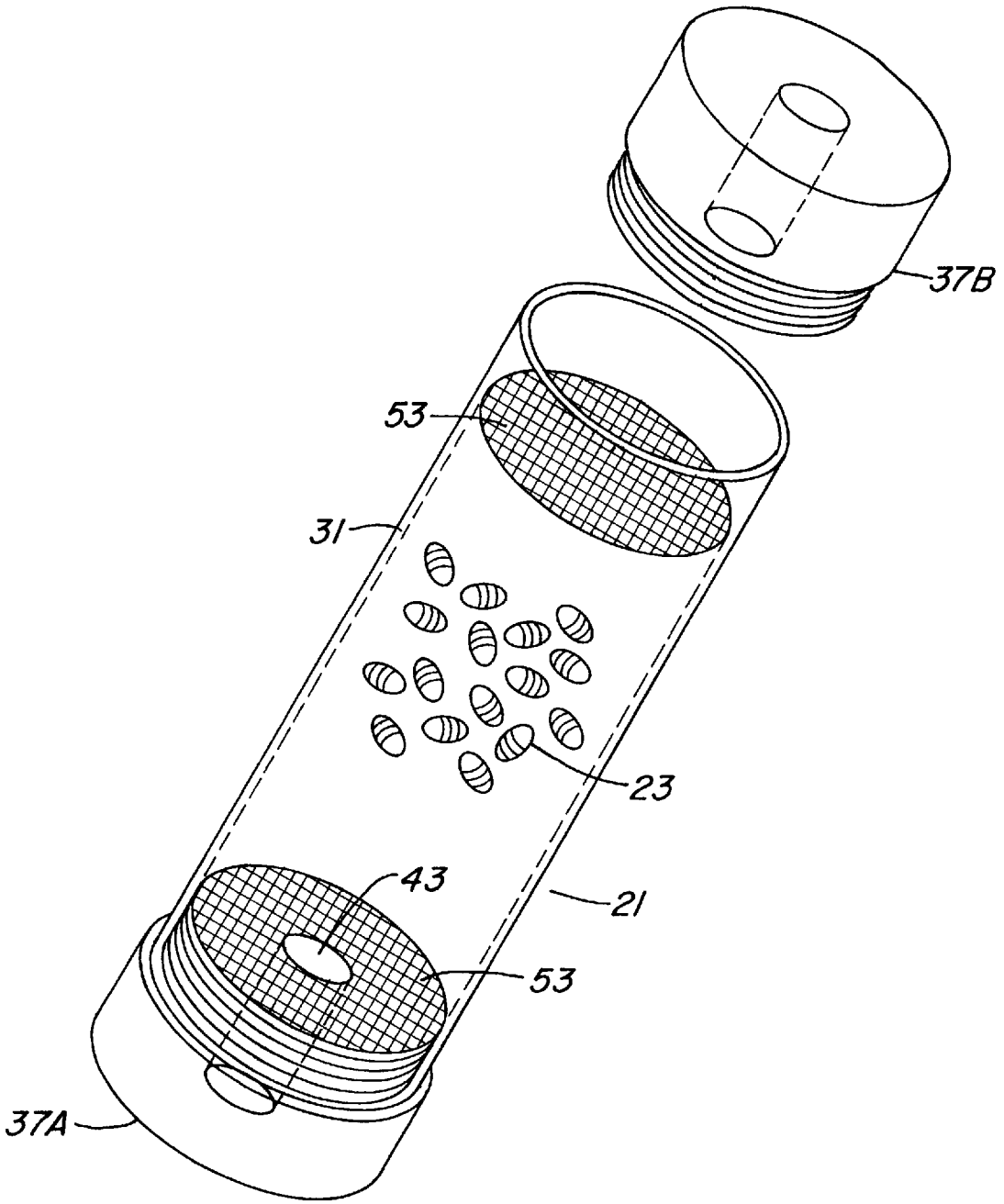
FIG. 1 is an isometric view of the preferred embodiment of the invention.
Figure 2:
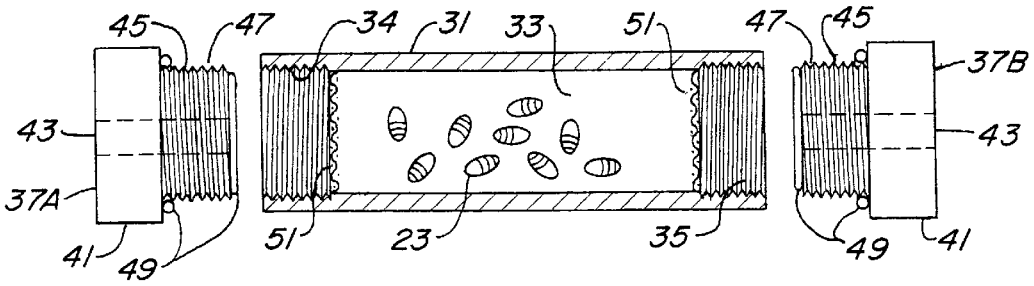
FIG. 2 is an exploded cross-section of FIG. 1.
Figure 3:
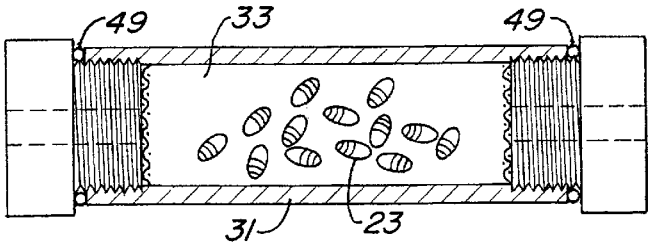
FIG. 3 is a cross-section of the apparatus of FIGS. 1 and 2 with the apparatus assembled.
Figure 4:
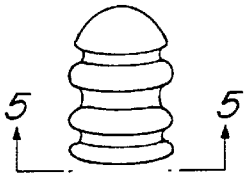
FIG. 4 is a side view of a pellet or bullet of one of the components of the invention.
Figure 5:
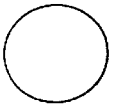
FIG. 5 is a view of FIG. 4 as seen along lines 5—5 thereof.

Referring to FIGS. 1–4 here is illustrated a canister or container 21 for holding a plurality of pellets or bullets 23. The canister comprises a hollow metal cylindrical wall 31 having an internal cavity 33 defining a flow path. The wall 31 has internal threads 34 and 35 at opposite ends to which two identical caps 37A and 37B are screwed. Each of the caps comprises a head 41 with an opening 43 formed therethrough and a cylindrical cap wall 45 with threads 47 to be screwed to the threads 34 and 35 of the cylindrical member 31. Members 49 are O-rings. Members 51 are annular screens with openings 53 which are secured to the inside of the wall 31 spaced inward from the two ends of the container 21. Located in the cavity 33 between the screens 51 are a plurality of the pellets or bullets 23. One of the openings 43 forms an inlet and the other opening 43 forms an outlet for the flow of the fuel.

The invention includes Aluminum, Lead, Copper, Tin, Antimony, Zinc, and Nickel forming a catalyst which contact the fuel flowing through the flow path 33 for treating the fuel for improving the efficiency of the fuel and for reducing harmful emission gases such as carbon monoxide, nitrous oxides, etc.

In the preferred embodiment, the wall 31 of the container is formed of Aluminum and the screens are 51 and are formed of Copper. The pellets 23 are formed of Lead, Tin, Antimony, Zinc and Nickel. Preferably Lead, Tin and Antinomy are melted together to form individual pellets. Zinc and Nickel form individual pellets, and additional pellets are formed of Copper.

In assembling the apparatus, one of the caps 37A is secured in place with a screen 51 located in the cavity 33 and secured to the wall 31 with a thread locking compound; the cavity 33 is filled with the pellets or bullets 23; the other screen 51 is located in the cavity 33 and secured to the wall 31 with a thread locking compound; and the other cap 37B is secured in place. Exterior tubes (not shown) are secured to the openings 43 of the caps 37A, 37B for the flow of fuel through the apparatus. Fuel flowing through the cavity 33 will come into contact with all of the elements, Aluminum, Lead, Copper, Tin, Antinomy, Zinc, and Nickel and be treated. The percentages of these elements by weight used as the catalyst are set forth in the following Table I for four different fuels.

TABLE I

| | (Al) Aluminum | (Pb) Lead | (Cu) Copper | (Sn) Tin | (Sb) Antimony | (Zi) Zinc | (Ni) Nickel |
|---|---|---|---|---|---|---|---|
| LPG-Propane | | | | | | | |
| Ranges by % | 38–45 | 2–4 | 3–5 | 30–60 | 22–40 | 1.5–3.0 | 2–4 |
| Preferred % | 40.0 | 3.0 | 3–5 | 32 | 26–40 | 2.0 | 2.5 |

TABLE I-continued

| | (Al) Aluminum | (Pb) Lead | (Cu) Copper | (Sn) Tin | (Sb) Antimony | (Zi) Zinc | (Ni) Nickel |
|---|---|---|---|---|---|---|---|
| Gasoline | | | | | | | |
| Ranges by % | 7–15 | 2–4 | 3–5 | 30–60 | 22–40 | 1.5–3.0 | 2–4 |
| Preferred % | 12.0 | 3.0 | 3 . 5 | 50.0 | 27.0 | 2.0 | 2.5 |
| Diesel | | | same percentages as gasoline | | | | |
| Ranges by % | | | simply more catalyst material in a larger canister | | | | |
| Preferred % | | | | | | | |
| Natural Gas | | | | | | | |
| Ranges by % | 7–15 | 2–4 | 3–5 | 30–60 | 22–40 | 6–10 | 5–8 |
| Preferred % | 12.0 | 3.0 | 4.0 | 45.0 | 20.0 | 8.0 | 6.5 |

There are other trace elements such as iron in the with the elements which do not form part of the catalyst and which are difficult to remove from an economic standpoint.

The aluminum canister size and weight is an integral part of the in all four examples given in Table I catalyst. For gasoline, diesel, and natural gas applications, the size and weight of the canister is less.

The copper (Cu), the zinc (Zi) and the nickel metals are melted separately from other metals and are placed in the canister when assembled.

More catalyst material and larger canisters are required as the horsepower and fuel flow requirements of the internal combustion engines increase to properly reduce emissions and increase fuel efficiency.

The LPG canister can be made from 6061 T aluminum tubing which is 3 inch OD with a ¼ inch or ⅜ inch wall thickness. There are 16 threads in each end that total one inch on each end. At the bottom of the threads there is a seat for a Bun-A 140-1/32 inch cross-section O-ring. The two end caps 37A and 37B are made from solid 3¼ inch 6061 T aluminium with ¼" normal pipe threads (NPT) orifices cut into the center of each end for fuel line connections. The two screens 53 at each end has 2" diameter with 1/32" thickness placed in both ends of the catalyst prior to the ends being secured by a thread locking compound that can withstand 10,000 psi and 600 degrees Fahrenheit. The lead, tin and antimony in the desired weight percentages are melted in a convection pot that is natural gas heated. The pot is sand-blasted prior to each batch being melted to lessen the possibility of contamination. The heat range is 650 degrees to 740 degrees Fahrenheit. When the metals have melted they are stirred by an agitator to obtain a homogenous solution or a substantially homogenous solution. After the above metals are in solution as desired then they are poured into approximately 42 pound bars each and allowed to cool and stacked for shipment. The 42 pound bars are then melted in a second process and poured into the appropriate sized bullet molds. The bullets are then boxed for shipment to the final assembly point. The metals Copper, Zinc and Nickel are melted separately to form the desired bullet size by weight. The canister is made from Aluminum as described above and acts as a part of the catalyst material. If the catalyst material is located in a canister made from a material other than Aluminum, such as a high pressure elastomer rubber hose or other products, then the of Aluminium is formed into pellets or bullets and added to the canister in the percentages listed above. The catalyst material in of Nickel, Zinc, and Copper in pellet form are inserted into the canister during the final assembly process. The appropriate weights of each of the three metals are weighted prior to inserting into the canister. The items are in small ingot and small-extruded pieces. The pellets of lead, tin, and antimony mixtures of appropriate weight are also inserted into the canister. Thread lock compound is placed on both end caps and allowed to set for a minimum of 24 hours before use to allow the locking compound to set up properly.

The weights of the catalysts are as follows:

TABLE 2

| Fuel Type | canister weight-empty | finished canister with product | sizes |
|---|---|---|---|
| LPG | 3 pounds 8 oz. | 7 pounds 4 oz. | 9" × 3" |
| Diesel | 2 pounds 12 oz. | 5 pounds 12 oz. | 7" × 3" |
| Gasoline | 2 pounds 6 oz. | 4 pounds 8 oz. | 5" × 3" |
| The outside diameter of the above canisters are 3 inches. | | | |
| Gasoline Small engine 40 HP and below | 10 ounces | 1 pound 10 oz. | 1½" × 10" |
| Natural Gas | The catalyst for natural gas are sized according to the fuel flow needs and pressure restraints give by each customer. | | |

Figure 6:
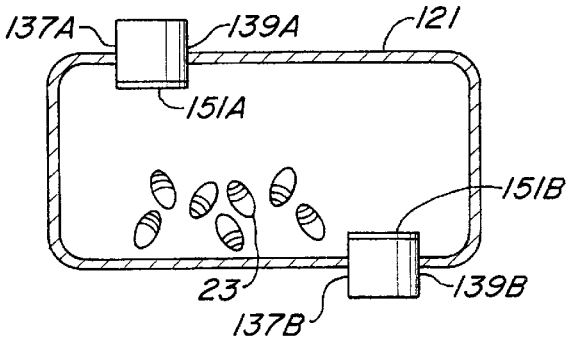
FIG. 6 is a cross-section of another embodiment of the invention.

The embodiment of FIG. 6 discloses a fuel tank 121 of a motor vehicle having an inlet 137A and an outlet 137B screwed into apertures 139A and 139B with screens 151A and 151B attached to their inner ends. If the tank 121 is formed of iron, the pellets 23 will be formed of aluminum, copper, zinc, nickel, lead-tin-antimony and will have appropriate weights such that they will have the desired percentages by weight.

Research and Development was conducted for a number of years or so before I came up with the invention formula.

I produced the catalyst and tested each prototype on LPG, diesel and gasoline internal combustion engines. Those tests consisted of emissions and fuel efficiency tests on each prototype. Towards the end of the Research and Development when it appeared that I had the proper formula to reduce emissions up to 90% and fuel efficiency increases in ranges of 15–20% for gasoline engines and 11% for diesels, I increased the test mileage's. I tested both gasoline and diesel vehicles over 50,000 miles each.

The Propane (LPG) fuel needs more of the catalyst material to treat it than diesel or gasoline. My reasoning for this is that the gasoline and diesel engines both have fuel return lines and LPG does not. The gasoline and diesel fuel is treated over and over against while traveling through the fuel supply and return lines. The gasoline and diesel that is not burnt in the combustion chamber is returned to the fuel tank to be recycled through the system until that portion actually reaches the combustion chamber and is expended.

Diesel requires more catalyst material, thus requiring a larger catalyst canister than a gasoline canister.

The metal component of Tin (Sn) is used because it is widely known that tin raises the quality of poor quality fuel, this was discovered in 1941 by Henry Brouquet of England. The Copper (Cu) helps in the change of the electrical charge over the fuel molecule.

The Antimony (Sb) is used commercially by many major oil companies and in plastics manufacturing to reduce emissions. This type of Antimony is in a powder form and dusted in the combustion area of the manufacturing process to reduce emissions.

Copper, Lead, Zinc and Nickel also help in altering the electrical charge of the minutely polarized molecules. The net effect of all these metals cause molecules in a colloidal aggregate to distance themselves from each other. These aggregates become smaller and a finer colloidal dispersion occurs.

The more finely divided colloids resulting from this catalyst have a greater mixing with air and combustion. The smaller particles, with the resilient larger total surface area, allows more contact with oxygen. Consequently, a more efficient burn and faster burning is plausible. In technical terms, this is a kinetic effect due to a physical change in the fuel. Such a faster burn during the fuel retention time in a combustion chamber results in a sharper peak of energy (per time) which logically should give a faster engine RPM. Higher RPM with the same amount of fuel thus extrapolate to more work done with the same amount of fuel, i.e. more miles per gallon. Furthermore, the faster the combustion process the more complete it might be also within the process time in the combustion chamber. As expected, the more complete combustion the less amount of pollutants such as unreacted hydrocarbon, carbon monoxide and nitrous oxide in the exhaust.

In another embodiment, the percentages of the elements by weight of the catalyst for either of the four fuels of Table I may be that which is listed in Table II. These percentages may achieve acceptable results in improving the efficiency of the fuels.

TABLE II

| Al | Pb | Cu | Sn | Sb | Zi | Ni |
|---|---|---|---|---|---|---|
| 30–60% | 2–9% | 2–10% | 25–75% | 18–50% | 1.5–8% | 1–10% |

The metals of the catalyst in order of importance are tin and antimony primarily with lead being third and the order of importance of aluminum, copper, zinc and nickel being fourth through seventh respectively. The aluminium, however, as the material for the container is useful since it is light weight, strong, durable and easy to form as a container. It is to be understood, however, that in some instances, the container may be made of a material other than aluminium such as a high pressure elastomer rubber hose. Suitable means will be provided for securing the screens 53 and caps 37A and 37B in place to the hose. If the container is not made of aluminum, the aluminum may be formed in pellet form. The Copper screens are a fine electrical conductor as well as a means to keep the catalyst bullets (pellets form blocking) or from passing through the orifice on the canister end caps.

In all embodiments, the surface area of the catalyst metals used is important in that generally more surface area of the catalyst metals results in increased efficiency of the fuels.

In the embodiment of Table I, there are two types of bullets (pellets) that are used in the LPG catalyst and the gasoline catalyst for a small gasoline engine. These sizes are the 50-caliber bullet for the LPG catalyst and the 30-caliber bullet for the small engine gasoline catalyst. The LPG catalyst efficiency and the catalyst efficiency for the other fuels is expected to be increased by the use of the smaller 30-caliber bullet or pellet or even smaller pellets since an increased number of bullets or pellets will provide more surface area of the catalyst material in a given canister volume.

I claim:

1. An apparatus for improving the fuel efficiency of a fuel and for reducing harmful emission gases upon combustion of the fuel, comprising:

a container formed of aluminum and having an inlet and an outlet for the flow of fuel, and a plurality of elements comprising Lead, Copper, Tin, Antimony, Zinc, and Nickel located in said container such that fuel passing through said container will contact the aluminum of said container, and said Lead, Copper, Tin, Antimony, Zinc, and Nickel, each of said elements is present in a concentration range by weight as follows: Aluminum about 38–45%; Lead about 2–4%; Copper about 3–5%; Tin about 30–60%; Antimony about 22–40%; Zinc about 1.5–3.0%; Nickel about 2–4%; whereby said apparatus is particularly useful for treating fuels such as LPG-Propane.

2. The apparatus of claim 1, wherein:

said Copper comprises two screens formed of Copper and located within said container near said inlet and outlet respectively with said Lead, Tin, Antimony, Zinc and Nickel being located between said two screens.

3. The apparatus of claim 2, wherein:

said Zinc and Nickel are formed as individual pellets and said Lead, Tin, and Antimony are combined together in each of a plurality of pellets.

4. An apparatus for improving the fuel efficiency of a fuel and for reducing harmful emission gases upon combustion of the fuel, comprising:

a container formed of Aluminium and having an inlet and an outlet for the flow of fuel, and a plurality of elements comprising Lead, Copper, Tin, Antimony, Zinc, and Nickel located in said container such that fuel passing through said container will contact the Aluminium of said container, and said Lead, Copper, Tin, Antimony, Zinc, and Nickel, each of said elements is present in a concentration range by weight as follows: Aluminium about 7–15%; Lead about 2–4%; Copper about 3–5%; Tin about 30–60%; Antimony about 22–40%; Zinc about 6–10%; Nickel about 5–8%; whereby said apparatus is particularly useful for treating fuels such as natural gas.

5. The apparatus of claim 4, wherein:

said Copper comprises two screens formed of Copper and located within said container near said inlet and outlet respectively with said Lead, Tin, Antimony, Zinc and Nickel being located between said two screens.

6. The apparatus of claim 5, wherein:

said Zinc and Nickel are formed as individual pellets and said Lead, Tin, and Antimony are combined together in each of a plurality of pellets.

7. An apparatus for improving the fuel efficiency of a fuel and for reducing harmful emission gases upon combustion of the fuel, comprising:

a container having a chamber with an inlet for receiving fuel and an outlet for the flow of fuel, a plurality of elements located to be exposed to fuel received in said chamber, said plurality of elements comprising Aluminium, Lead, Copper, Tin, Antimony, Zinc, and Nickel, each of said elements is present in a concentration range by weight as follows: Aluminium about 38–45%; Lead about 2–4%; Copper about 3–5%; Tin about 30–60%; Antimony about 22–40%; Zinc about 1.5–3.0%; Nickel about 2–4%; whereby said apparatus is particularly useful for treating fuels such as LPG-Propane.

8. The apparatus of claim 7, wherein:

said container comprises a flow path for fuel, said elements being located to be exposed to fuel passing through said flow path.

9. The apparatus of claim 7, wherein:

said container comprises a fuel storage apparatus.

10. An apparatus for improving the fuel efficiency of a fuel and for reducing harmful emission gases upon combustion of the fuel, comprising:

a container formed of Aluminum and having an inlet and an outlet for the flow of fuel, and a plurality of elements comprising Lead, Copper, Tin, Antimony, Zinc, and Nickel located in said container such that fuel passing through said container will contact the Aluminum of said container, and said Lead, Copper, Tin, Antimony, Zinc, and Nickel, each of said elements is present in a concentration range by weight as follows: Aluminum about 7–15%; Lead about 2–4%; Copper about 3–5%; Tin about 30–60%; Antimony about 22–40%; Zinc about 1.5–3.0%; Nickel about 2–4%; whereby said apparatus is particularly useful for treating fuels such as gasoline and diesel.

11. The apparatus of claim 10, wherein:

each of said elements is present in a concentration range by weight as follows: Aluminum about 12%; Lead about 3%; Copper about 3–5%; Tin about 50%; Antimony about 27%; Zinc about 2%; and Nickel about 2.5%.

12. The apparatus of claim 10, wherein:

said Copper comprises two screens formed of Copper and located within said container near said inlet and outlet respectively with said Lead, Tin, Antimony, Zinc and Nickel being located between said two screens.

13. The apparatus of claim 12, wherein:

each of said elements is present in a concentration range by weight as follows: Aluminum about 12%; Lead about 3%; Copper about 3–5%; Tin about 50%; Antimony about 27%; Zinc about 2%; and Nickel about 2.5%.

14. The apparatus of claim 12, wherein:

said Zinc and Nickel are formed as individual pellets and said Lead, Tin, and Antimony are combined together in each of a plurality of pellets.

15. The apparatus of claim 14, wherein:

each of said elements is present in a concentration range by weight as follows: Aluminum about 12%; Lead about 3%; Copper about 3–5%; Tin about 50%; Antimony about 27%; Zinc about 2%; and Nickel about 2.5%.

16. An apparatus for improving fuel efficiency and for reducing harmful emission gases, comprising:

a container having a chamber with an inlet for receiving fuel and an outlet for the flow of fuel, a plurality of elements located to be exposed to fuel received in said chamber, said plurality of elements comprising Aluminium, Lead, Copper, Tin, Antimony, Zinc, and Nickel, each of said elements is present in a concentration range by weight as follows: Aluminium about 7–15%; Lead about 2–4%; Copper about 3–5%; Tin about 30–60%; Antimony about 22–40%; Zinc about 1.5–3.0%; Nickel about 2–4%; whereby said apparatus is particularly useful for treating fuels such as gasoline and diesel.

17. The apparatus of claim 16, wherein:

said container comprises a flow path for fuel, said elements being located to be exposed to fuel passing through said flow path.

18. The apparatus of claim 16, wherein:

said container comprises a fuel storage apparatus.

19. The apparatus of either of claims 16, 17, or 18 wherein:

each of said elements is present in a concentration range by weight as follows: Aluminum about 12%; Lead about 3%; Copper about 3–5%; Tin about 50%; Antimony about 27%; Zinc about 2%; and Nickel about 2.5%.

20. An apparatus for improving fuel efficiency and for reducing harmful emission gases, comprising:

a container having a chamber with an inlet for receiving fuel and an outlet for the flow of fuel, a plurality of elements located to be exposed to fuel received in said chamber, said plurality of elements comprising Aluminium, Lead, Copper, Tin, Antimony, Zinc, and Nickel, each of said elements is present in a concentration range by weight as follows: Aluminum about 7–15%; Lead about 2–4%; Copper about 3–5%; Tin about 30–60%; Antimony about 22–40%; Zinc about 6–10%; and Nickel about 5–8%.

21. The apparatus of claim 20, wherein:

said container comprises a flow path for fuel, said elements being located to be exposed to fuel passing through said flow path.

22. The apparatus of claim 20, wherein:

said container comprises a fuel storage apparatus.

23. An apparatus for improving fuel efficiency and for reducing harmful emission gases, comprising:

a container having a chamber with an inlet for receiving fuel and an outlet for the flow of fuel, a plurality of elements located to be exposed to fuel received in said chamber, said plurality of elements comprising Aluminium, Lead, Copper, Tin, Antimony, Zinc, and Nickel, each of said elements is present in a concentration range by weight as follows: Aluminium about 30–60%; Lead about 2–9%; Copper about 2–10%; Tin about 25–75%; Antimony about 18–50%; Zinc about 1.5–8%; Nickel about 1–10%.

* * * * *